US009719361B2

(12) United States Patent
Cave et al.

(10) Patent No.: US 9,719,361 B2
(45) Date of Patent: Aug. 1, 2017

(54) SYNTHETIC JETS IN COMPRESSORS

(71) Applicants: SOLAR TURBINES INCORPORATED, San Diego, CA (US); San Diego State University Research Foundation, San Diego, CA (US)

(72) Inventors: Michael James Cave, Oceanside, CA (US); Ricardo Benjamin Torres, San Diego, CA (US); Gustaaf Bernardus Jacobs, La Mesa, CA (US)

(73) Assignee: Solar Turbines Incorporated, San Diego, CA (US)

( * ) Notice: Subject to any disclaimer, the term of this patent is extended or adjusted under 35 U.S.C. 154(b) by 845 days.

(21) Appl. No.: 14/154,947

(22) Filed: Jan. 14, 2014

(65) Prior Publication Data

US 2015/0198169 A1 Jul. 16, 2015

(51) Int. Cl.
*F01D 5/14* (2006.01)
*F01D 9/06* (2006.01)
(Continued)

(52) U.S. Cl.
CPC ..... *F01D 9/02* (2013.01); *F01D 15/10* (2013.01); *F04D 29/023* (2013.01); *F04D 29/284* (2013.01); *F04D 29/288* (2013.01); *F04D 29/30* (2013.01); *F04D 29/444* (2013.01); *F04D 29/682* (2013.01); *F04D 29/684* (2013.01); *F04D 33/00* (2013.01); *F05D 2250/51* (2013.01); *F05D 2250/52* (2013.01);
(Continued)

(58) Field of Classification Search
CPC ... B64C 23/005; B64C 2230/02; F01D 5/145; F01D 5/148; F01D 9/02; F01D 9/041; F01D 9/065; F04D 29/30; F04D 29/682; F04D 29/684; Y02T 50/162
USPC ..... 251/129.06; 415/116
See application file for complete search history.

(56) References Cited

U.S. PATENT DOCUMENTS 4,923,000 A * 5/1990 Nelson ..... F04D 33/00 165/122
5,957,413 A 9/1999 Glezer et al.
(Continued)

FOREIGN PATENT DOCUMENTS

WO 2008069937 A2 6/2008

OTHER PUBLICATIONS

Horn, et al., Actively Controlled Components, NATO Science and Technology Organization, RTO Applied Vehicle Technology Panel Task Group 128, Apr. 2009, pp. 2-1 to 2-40.
(Continued)

*Primary Examiner* — Sean J Younger
(74) *Attorney, Agent, or Firm* — Procopio, Cory, Hargreaves & Savitch LLP

(57) ABSTRACT

A synthetic jet for a stationary vane for a turbo-machine is disclosed. The synthetic jet includes a backside cavity and a jet cavity. The jet cavity includes a frontside cavity adjoining the backside cavity and a jet passage extending from a fluid stream interfacing surface of the airfoil towards the frontside cavity. The jet passage is in flow communication with the frontside cavity. The synthetic jet also includes a disk located between the backside cavity and the frontside cavity. The disk includes a cylindrical disk and a coating on each side of the cylindrical disk. The coating is a piezo electric ceramic material.

18 Claims, 5 Drawing Sheets

(51) Int. Cl.

| | |
|---|---|
| ***F04D 29/68*** | (2006.01) |
| ***B64C 23/00*** | (2006.01) |
| ***F01D 9/02*** | (2006.01) |
| ***F04D 29/02*** | (2006.01) |
| ***F04D 29/28*** | (2006.01) |
| ***F04D 29/30*** | (2006.01) |
| ***F04D 33/00*** | (2006.01) |
| ***F01D 15/10*** | (2006.01) |
| ***F04D 29/44*** | (2006.01) |

(52) U.S. Cl.
CPC .... *F05D 2300/172* (2013.01); *F05D 2300/20* (2013.01); *F05D 2300/611* (2013.01)

(56) References Cited

U.S. PATENT DOCUMENTS 5,983,944 A * 11/1999 Niv ..... B64C 23/04 137/831
6,308,740 B1 * 10/2001 Smith ..... F02C 7/04 137/892
6,412,732 B1 * 7/2002 Amitay ..... B64C 23/005 244/200
6,644,598 B2 11/2003 Glezer et al.
6,722,581 B2 * 4/2004 Saddoughi ..... B64C 23/06 239/102.1
7,059,664 B2 * 6/2006 Aase ..... B60K 11/085 244/201
7,178,859 B2 * 2/2007 Browne ..... B62D 35/00 296/180.1
7,686,257 B2 * 3/2010 Saddoughi ..... B05B 1/08 244/198
7,748,664 B2 * 7/2010 Boespflug ..... B64C 23/005 239/265.19
7,854,467 B2 * 12/2010 McKnight ..... F15D 1/10 296/180.1
7,967,258 B2 * 6/2011 Smith ..... B64C 21/08 239/102.2
8,006,917 B2 * 8/2011 Arik ..... F15D 1/00 239/102.2
8,016,245 B2 9/2011 Hassan et al.
8,136,767 B2 * 3/2012 Cueman ..... B64C 21/00 244/204
8,348,200 B2 * 1/2013 Saddoughi ..... B05B 17/0607 244/200.1
8,490,926 B2 * 7/2013 Clingman ..... B64C 21/04 244/207
2003/0075615 A1 4/2003 Saddoughi
2008/0149205 A1 6/2008 Gupta et al.
2010/0043900 A1 * 2/2010 Xu ..... F15D 1/12 137/803
2010/0104436 A1 4/2010 Herr et al.

OTHER PUBLICATIONS

Zheng, et al., Separation Control Using Synthetic Vortex Generator Jets in Axial Compressor Cascade, National Key Laboratory of Aircraft Engine, Beihang University, Nov. 2006, pp. 521-527, Beijing, China.
Benini, et al., Efficiency Enhancement in Transonic Compressor Rotor Blades Using Synthetic Jets: A Numerical Investigation, Applied Energy, Mar. 2011, pp. 953-962, vol. 88, Issue 3.
Blankson, Isaiah M., Nasa GRC Research in Aerospace Propulsion with Potential Collaboration Opportunities, Great Midwestern Region Space Grant Consortia Meeting, Sep. 23-25, 2009, pp. 1-97.
Matejka, et al., Separation Control by Synthetic Jet Actuator in a Straight Blade Cascade, 26th International Congress of The Aeronautical Sciences, 2008, pp. 1-8.

* cited by examiner

SYNTHETIC JETS IN COMPRESSORS

TECHNICAL FIELD

The present disclosure generally pertains to turbo-machinery, and is more particularly directed toward a synthetic jet for enhancing the operating range of a turbo-machine, such as a compressor.

BACKGROUND

Turbo-machines, such as centrifugal gas compressors and gas turbine engines often use stationary vanes to redirect a gas, such as air, traveling through the turbo-machine. The stationary vanes are often mechanically actuated to modify the flow direction of the gas.

The flow direction of the gas can also be modified without mechanically actuating and rotating the stationary vanes. U.S. Pat. No. 7,967,258 to B. Smith discloses a system and method for actively manipulating fluid flow over a surface using synthetic pulsators. Synthetic pulsators produce pulsed jet operable to manipulate the primary fluid flow proximate to the synthetic pulsator. The synthetic pulsator includes a synthetic jet actuator(s) located within an ambient pressure chamber, wherein the synthetic jet actuator is operable to produce an oscillatory flow. The oscillatory flow of the synthetic jet(s) produces the pulsed jet operable to manipulate the primary fluid flow. These synthetic pulsators may then be actively manipulated to control the flow behavior of the ducted fluid flow, influence the inception point and trajectory of flow field vortices within the fluid flow, and reduce flow separation within the primary fluid flow.

The present disclosure is directed toward overcoming one or more of the problems discovered by the inventors or that is known in the art.

SUMMARY OF THE DISCLOSURE

In one embodiment, a synthetic jet for a turbo-machine is disclosed. The turbo-machine includes a fluid stream interfacing structure with a fluid stream interfacing surface. The synthetic jet includes a disk, a backside cavity, and a jet cavity. The disk includes a cylindrical disk and a coating. The cylindrical disk includes a cylindrical shape and a diameter from 40.8 millimeters to 41.2 millimeters. The coating is located on each side of the cylindrical disk. The coating is a piezo electric ceramic material. The backside cavity is located in the fluid stream interfacing structure. The jet cavity is located in the fluid stream interfacing structure and has a Helmholtz frequency within twenty percent of a resonant frequency of the disk. The jet cavity includes a frontside cavity, a cavity passage, and a jet passage. The frontside cavity adjoins the backside cavity. The frontside cavity is separated from backside cavity by the disk. The cavity passage extends from the frontside cavity towards the fluid stream interfacing surface. The jet passage extends from the fluid stream interfacing surface to the cavity passage. The jet passage is in flow communication with the frontside cavity.

In another embodiment, a stationary vane for a turbo-machine is disclosed. The stationary vane including an airfoil and a synthetic jet located within the airfoil. The airfoil includes a leading edge, a trailing edge, and a fluid stream interfacing surface extending between the leading edge and the trailing edge. The synthetic jet includes a backside cavity and a jet cavity. The jet cavity includes a frontside cavity adjoining the backside cavity and a jet passage extending from the fluid stream interfacing surface towards the frontside cavity. The jet passage is in flow communication with the frontside cavity. The synthetic jet also includes a disk located between the backside cavity and the frontside cavity. The disk includes a cylindrical disk with a cylindrical shape and a coating on each side of the cylindrical disk. The coating is a piezo electric ceramic material.

DETAILED DESCRIPTION

The systems and methods disclosed herein include a synthetic jet disposed within a fluid stream interfacing structure, such as an airfoil, of a turbo-machine that transfers energy between a rotor and a fluid. In embodiments, the synthetic jet includes a backside cavity and a jet cavity with a disk disposed therein. The jet cavity includes a jet passage configured to direct a secondary gas stream into a primary gas stream. When configured to inject the secondary gas stream perpendicular to a fluid stream interfacing surface, the synthetic jet may be used to turn the flow of the primary gas stream. When configured to inject the secondary gas stream an a tangential direction relative to the fluid stream interfacing surface, the synthetic jet may be used to reduce or prevent flow separation along the fluid stream interfacing surface.

Figure 1:
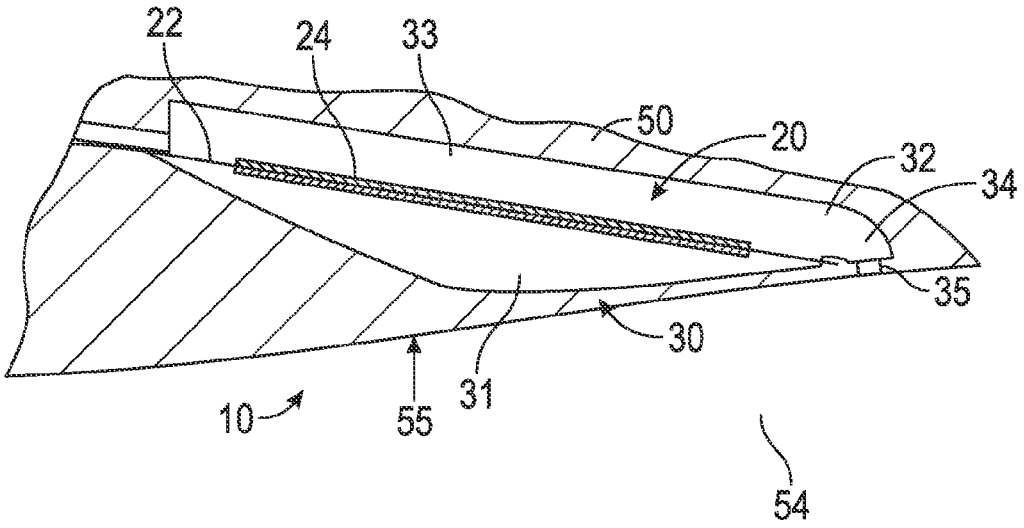
FIG. 1 is a cross-sectional view of an exemplary synthetic jet.

FIG. 1 is a cross-sectional view of an exemplary synthetic jet 10. As illustrated, synthetic jet 10 is located within a fluid stream interfacing structure 50, such as a wall of a diffuser, an airfoil, and the like of a turbo-machine. The turbo-machine may be a centrifugal gas compressor, a gas turbine engine, and the like. The fluid stream interfacing structure 50 generally includes a fluid stream interfacing surface 55, such as a diffusing surface, a pressure side surface of an airfoil, or a suction side surface of an airfoil. The fluid stream interfacing surface 55 may be configured to change and modify the direction of a fluid stream, such as a gas fluid stream.

Synthetic jet 10 includes a cavity 30 and a disk 20. In the embodiment illustrated, cavity 30 is located in fluid stream interfacing structure 50 adjacent fluid stream interfacing surface 55. In other embodiments, cavity 30 is located within adjoining walls or portions of fluid stream interfacing structure 50. Cavity 30 is generally sized to fit disk 20 and is configured to direct a gas fluid into and out of an jet passage 35. Cavity 30 may include a backside cavity 31, and a jet cavity 32. Backside cavity 31 may be sized to allow for deformation of disk 20. In the embodiment illustrated, backside cavity 31 is a conical shape with a rounded apex. Other shapes, such as a spherical cap or a cylinder may also be used.

Jet cavity 32 is in flow communication with a fluid duct 54, such as a diffuser, formed all or in part by fluid stream interfacing structure 50. In the embodiment illustrated, jet cavity 32 includes a frontside cavity 33, a cavity passage 34, and a jet passage 35. Frontside cavity 33 may be a cylindrical shape adjoining backside cavity 31. The diameter of the cylindrical shape may be the same or similar to the diameter of the base of the conical or spherical cap shape. The interface between the backside cavity 31 and the frontside cavity 33 may be configured to secure disk 20 within cavity 30. Backside cavity 31 may be separated from frontside cavity 33 by disk 20. When disk 20 is in place, frontside cavity 33 may not be in flow communication with backside cavity 31.

Cavity passage 34 may be configured to direct the gas fluid between frontside cavity 33 and jet passage 35. Cavity passage 34 may extend from frontside cavity 33 towards fluid stream interfacing surface 55.

Jet passage 35 extends between cavity passage 34 and fluid stream interfacing surface 55. Jet passage 35 is in flow communication with frontside cavity 33 and with fluid duct 54. Jet passage 35 may be a narrow neck and may include a cylindrical shape. Jet passage may also include other shapes, such as a slot with a rectangular cross-section. In the embodiment illustrated, jet passage 35 is configured to modify a flow direction of a fluid traveling along fluid stream interfacing surface 55 and is angled perpendicular to fluid stream interfacing surface 55 at the exit/location of jet passage 35, such as a portion of fluid stream interfacing surface adjacent jet passage 35. In other embodiments, jet passage is configured to reduce/prevent slow separation and is angled from 0 degrees to 7 from the tangential direction of fluid stream interfacing surface 55. In yet other embodiments, jet passage is angled from 0 degrees to 5 from the tangential direction of fluid stream interfacing surface 55.

Jet cavity 32 may be sized so that the Helmholtz frequency of jet cavity 32 matches the resonant frequency of disk 20. In one embodiment, the Helmholtz frequency of jet cavity 32 is within twenty percent of the resonant frequency of disk 20. In another embodiment, the Helmholtz frequency of jet cavity 32 is within 200 hertz of the disk resonant frequency. In yet another embodiment, the Helmholtz frequency of jet cavity 32 is approximately 1400 hertz. The Helmholtz frequency is defined by:

$$f_H = \frac{v}{2\pi}\sqrt{\frac{A}{V_0 h_{eff}}}$$

where $f_H$ is the Helmholtz frequency, v is the speed of sound in the gas, A is the cross-sectional area of jet passage 35 at fluid stream interfacing surface 55, $V_0$ is the static volume of jet cavity 32, and $h_{eff}$ is the effective depth of jet cavity 32. In one embodiment, A is from 7.41 $mm^2$ (0.0115 $in.^2$) to 8.38 $mm^2$ (0.013 $in.^2$), $V_0$ is from 4.11 $cm^3$ (0.25 $in.^3$) to 4.47 $cm^3$ (0.27 $in.^3$), and $h_{eff}$ is from 2.59 mm (0.102 in.) to 4.74 mm (0.165 in.). In another embodiment, A is from 18.722 $mm^2$ (0.029 $in.^2$) to 21.818 $mm^2$ (0.0338 $in.^2$), $V_0$ is from 4.592 $cm^3$ (0.28 $in.^3$) to 4.920 $cm^3$ (0.300 $in.^3$), and $h_{eff}$ is from 7.823 mm (0.308 in.) to 9.499 mm (0.374 in.). In yet another embodiment, A is approximately 7.42 $mm^2$ (0.0115 $in.^2$), $V_0$ is approximately 4.10 $cm^3$ (0.25 $in.^3$), and $h_{eff}$ is approximately 2.59 mm (0.102 in.). In a further embodiment, A is approximately 21.818 $mm^2$ (0.0338 $in.^2$), $V_0$ is approximately 4.592 $cm^3$ (0.28 $in.^3$), and $h_{eff}$ is approximately 7.823 mm (0.308 in.).

Disk 20 includes cylindrical disk 22 and coating 24. Disk 20 may be located between backside cavity 31 and frontside cavity 33, and may divide backside cavity 31 from frontside cavity 33. In some embodiments, the resonant frequency of disk 20 is from 1150 hertz to 1250 hertz. In other embodiments, the resonant frequency of disk 20 is approximately 1200 hertz.

Figure 2:
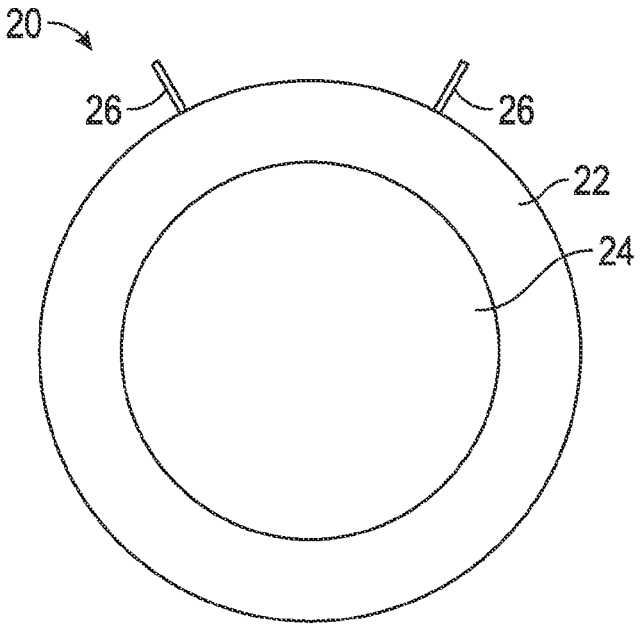
FIG. 2 is a top view of the disk for the synthetic jet of FIG. 1.
Figure 3:
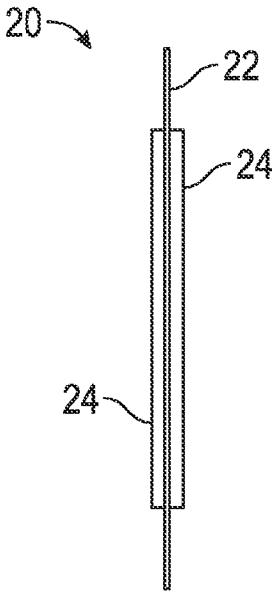
FIG. 3 is a side view of the disk of FIG. 2.

FIG. 2 is a top view of the disk 20 for the synthetic jet of FIG. 1. FIG. 3 is a side view of the disk 20 of FIG. 2. Referring to FIGS. 2 and 3, cylindrical disk 22 may include a cylindrical shape. In one embodiment, cylindrical disk 22 has a diameter from 40.8 mm (1.606 in.) to 41.2 mm (1.622 in.). In another embodiment, cylindrical disk 22 has a diameter of 41.0 mm (1.614 in.). In some embodiments, the thickness of cylindrical disk 22 is from 0.0508 mm (0.002 in.) to 0.1524 mm (0.006 in.). In another embodiment, the thickness of cylindrical disk 22 is 0.1016 mm (0.004 in.).

Coating 24 may be located on each side of cylindrical disk 22 and may extend from each side of cylindrical disk 22. In the embodiment illustrated, the coating 24 on each side of the cylindrical disk 22 includes a cylindrical shape. In one embodiment, the coating 24 on each side of the cylindrical disk 22 has a diameter from 28.0 mm (1.102 in.) to 28.4 mm (1.118 in.). In another embodiment, the coating 24 on each side of the cylindrical disk 22 has a diameter of 28.2 mm (1.110 in.). In some embodiments, the thickness of coating 24 on each side of cylindrical disk 22 is from 0.1778 mm (0.007 in.) to 0.2032 mm (0.008 in.). In other embodiments, the thickness of coating 24 on each side of cylindrical disk 22 is 0.1905 mm (0.0075 in.).

In some embodiments, the combined thickness of cylindrical disk 22 and coating 24 is from 0.4318 mm (0.0.017 in.) to 0.5334 mm (0.021 in.). In other embodiments, the combined thickness of cylindrical disk 22 and coating 24 is 0.4826 mm (0.019 in.).

Disk 20 may be a piezo electric bimorph disk and may be configured to oscillate when power is supplied to it. Cylindrical disk 22 may be made from brass, stainless steel, or a nickel alloy. Coating 24 is a piezo electric ceramic material. The piezo electric material may be lead zirconate titanate, such as PZT provided by American Piezo. Applying coating 24 to both sides of cylindrical disk 22 may enable cylindrical disk 22 to deform back and forth in both directions. The deformation is created by changing the polarity of coating 24, which occurs in a piezo electric ceramic material based on an applied voltage.

Disk 20 includes electric leads 26. The voltage may be applied to disk 20 through electric leads 26 from a variable alternating current (AC) power supply. Disk 20 may have a maximum displacement distance, the amount of deformation of disk 20 in a single direction, that correlates to a maximum voltage. Any deviation, up or down, from this maximum voltage will result in less displacement in disk 20. The alternating voltage of an applied AC power will cause the disk to oscillate back and forth up to a displacement distance in each direction that correlates with the voltage of the applied AC power. This displacement distance can be increased up to the maximum displacement distance by increasing the applied AC power voltage up to the maximum voltage.

Referring again to FIG. 1, the oscillation of disk 20 within cavity 30 may cause gas to be drawn into cavity 30, for example by deforming disk 20 into backside cavity 31, and may cause gas to be discharged from cavity 30, for example by deforming disk 20 into frontside cavity 33. The oscillation of disk 20 may form an injected region of the gas within the fluid duct 54 adjacent jet passage 35. The injected region may include the recirculation of gas that flows out of cavity 30 through the center of jet passage 35 and flows into cavity 30 at the edge of jet passage 35.

Figure 4:
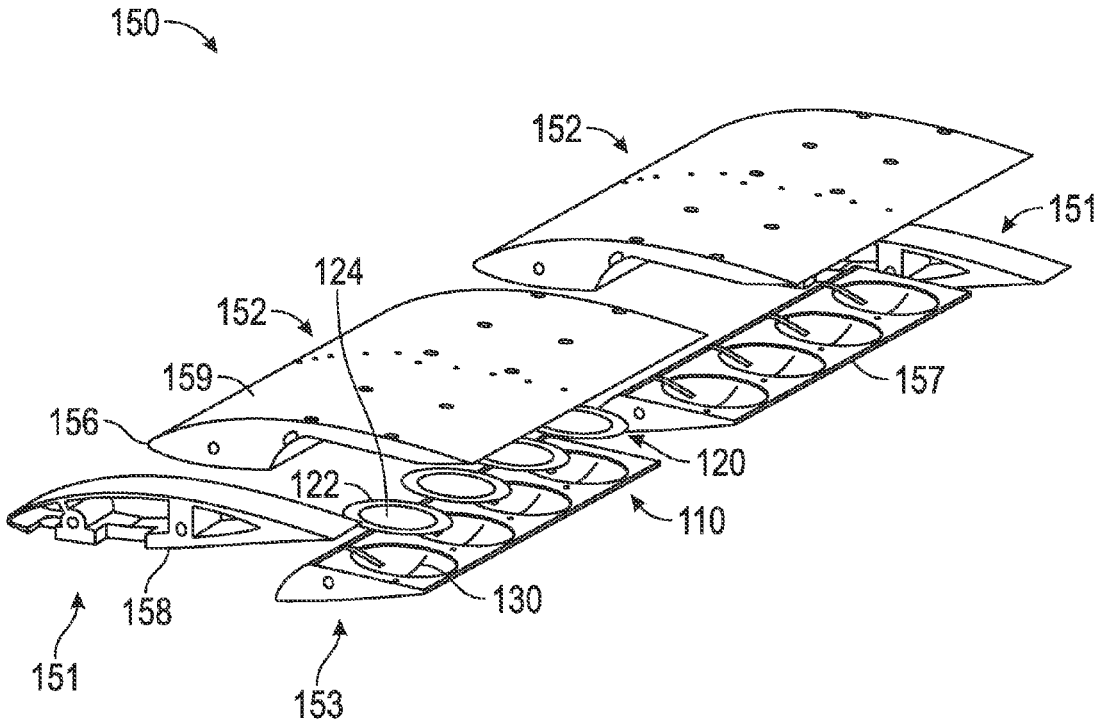
FIG. 4 is an exploded view an airfoil assembly including the synthetic jet of FIG. 1.

FIG. 4 is an exploded view of an airfoil assembly 150 including the synthetic jet 110 of FIG. 1. Airfoil assembly 150 may be part of a turbo-machine, such as a stationary vane for a centrifugal gas compressor or a gas turbine engine. Airfoil assembly 150 includes a leading edge 156, a trailing edge 157, a pressure side 158, and a suction side 159. Leading edge 156 is generally configured to be the upstream edge of airfoil assembly 150 and trailing edge 157 is configured to be the downstream edge of airfoil assembly 150. Pressure side 158 and suction side 159 each extend from leading edge 156 to trailing edge 157.

Airfoil assembly 150 includes a first body portion 152, a second body portion 153, and end caps 151. First body portion 152 includes leading edge 156, trailing edge 157, suction side 159, a portion of pressure side 158 adjacent leading edge 156, and a portion of pressure side 158 adjacent trailing edge 157. Second body portion 153 may include the remainder of pressure side 158 extending between the portions of pressure side 158 of first body portion 152. First body portion 152 and second body portion 153 are coupled/affixed to form the airfoil shape. End caps 151 each include an airfoil shape. End caps 151 are coupled to each end of the assembled first body portion 152 and second body portion 153. In the embodiment illustrated in FIG. 4, airfoil assembly 150 includes two assemblies of first body portion 152 and second body portion 153.

Figure 5:
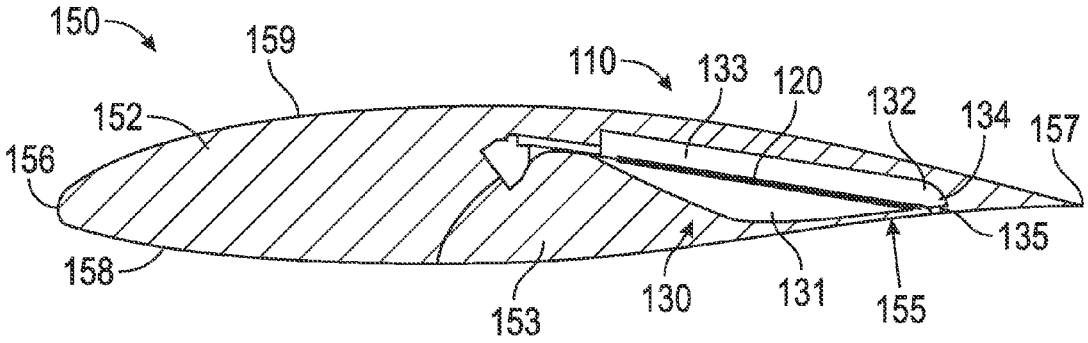
FIG. 5 is a cross-sectional view of the airfoil assembly of FIG. 4.

FIG. 5 is a cross-sectional view of the airfoil assembly 150 of FIG. 4. Referring to FIGS. 4 and 5, airfoil assembly 150 includes synthetic jet 110. The various components, shapes, sizes, and operation of synthetic jet 110, such as disk 120 including cylindrical disk 122 and coating 124, and cavity 130 including backside cavity 131 and jet cavity 132 along with frontside cavity 133, cavity passage 134, and jet passage 135 may be the same or similar to the description of synthetic jet 10, such as disk 20 including cylindrical disk 22 and coating 24, and cavity 30 including backside cavity 31 and jet cavity 32 along with frontside cavity 33, cavity passage 34, and jet passage 35.

In the embodiment illustrated, backside cavity 131 is located within second body portion 153 at the interface between first body portion 152 and second body portion 153. Jet cavity 132 is located within the first body portion 152 adjoining the backside cavity 131 at the interface between first body portion 152 and second body portion 153. Disk 120 is secured between the backside cavity 131 and the jet cavity 132 by the interface between first body portion 152 and second body portion 153. Jet passage 135 extends from a fluid stream interfacing surface 155 towards frontside cavity 133. In the embodiment illustrated, the fluid stream interfacing surface 155 is on the pressure side. In other embodiments, the fluid stream interfacing surface 155 is on the suction side.

Figure 6:
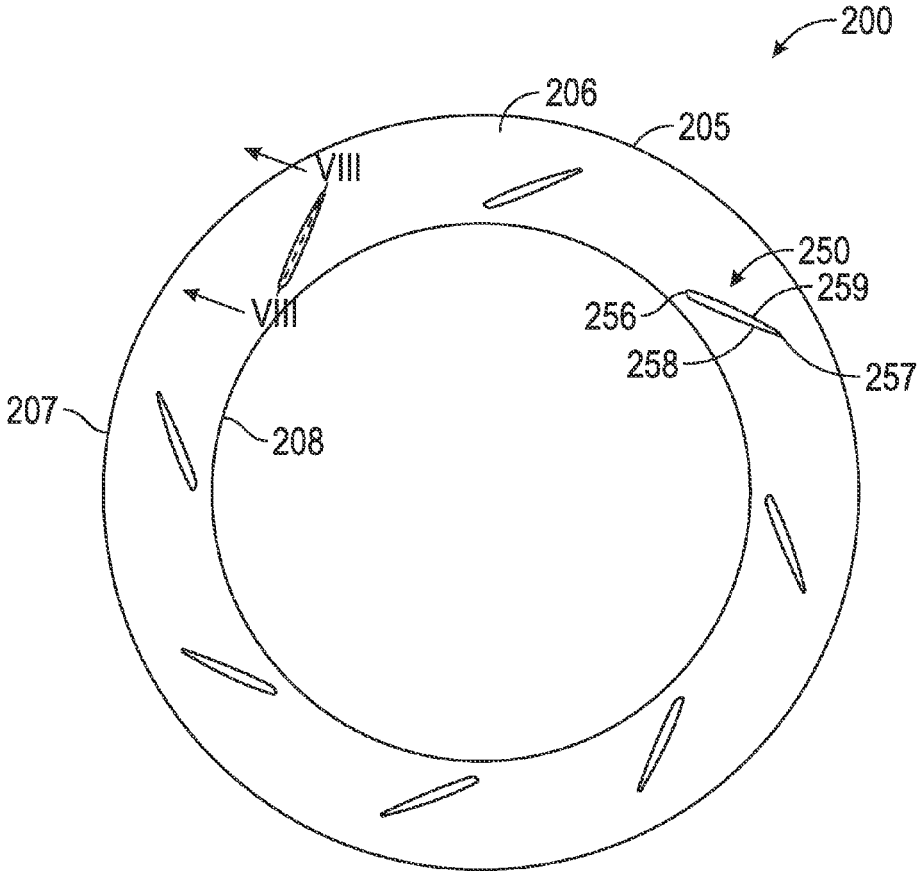
FIG. 6 is a top view of a turbo-machine low solidity airfoil plate including an alternate embodiment of the synthetic jet of FIG. 1.

FIG. 6 is a top view of a turbo-machine low solidity airfoil (LSA) plate 200 including an alternate embodiment of the synthetic jet 210 of FIG. 1. LSA plate 200 may be all or a portion of a stationary vane assembly. LSA plate 200 includes a plate portion 205 and airfoils 250. Plate portion 205 may be an annular disk. Plate portion 205 may include a first base surface 206 with an annular shape, an outer edge 207 defining the outer circumference of plate portion 205, and an inner edge 208 defining the inner circumference of plate portion 205. The inner edge 208 may be sized to fit a rotor of a turbo-machine, such as an impeller. Inner edge 208 may be located inward from outer edge 207.

Figure 8:
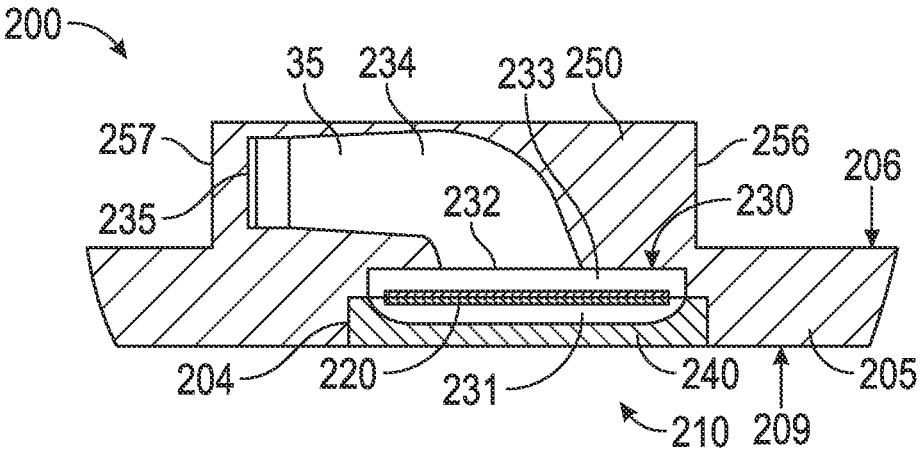
FIG. 8 is a cross-sectional view of the low solidity airfoil plate of FIG. 6.

Airfoils 250 may extend from first base surface 206 in the axial direction of plate portion 205, the direction opposite second base surface 209 (shown in FIG. 8). Each airfoil 250 includes a leading edge 256, a trailing edge 257, a pressure side 258, and a suction side 259. In the embodiment illustrated, leading edge 256 is adjacent inner edge 208, such as closer to inner edge 208 than outer edge 207, trailing edge 257 is adjacent outer edge 207, such as closer to outer edge 207 than inner edge 208, pressure side 258 is facing towards inner edge 208, and suction side 259 is facing towards outer edge 207.

Figure 7:
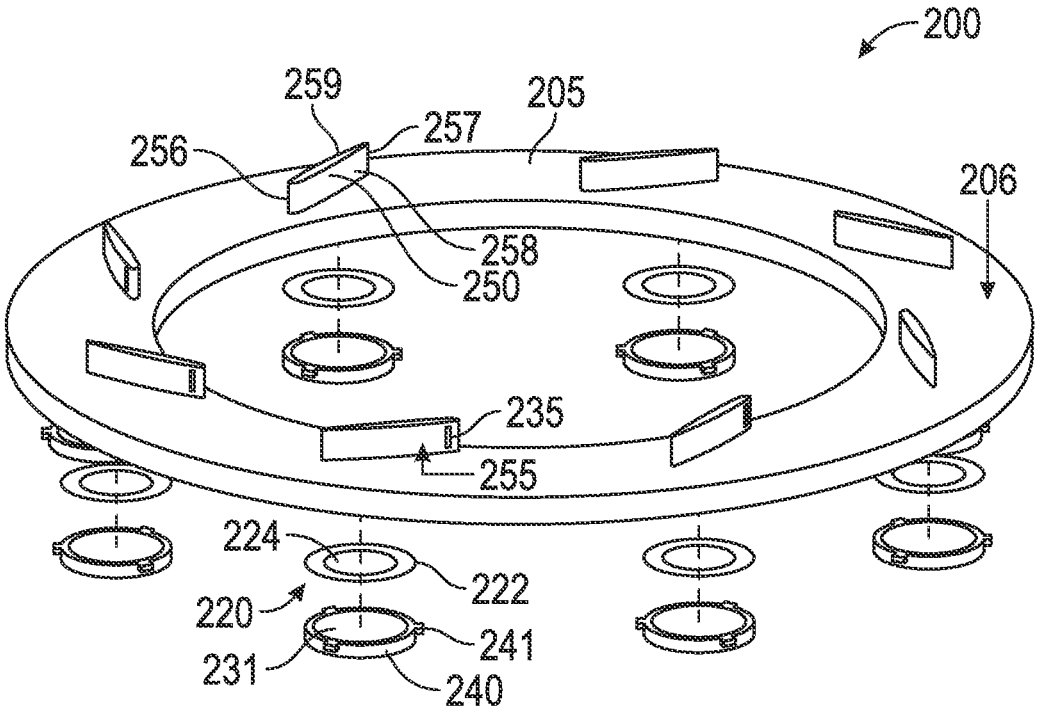
FIG. 7 is an exploded view of the low solidity airfoil plate of FIG. 6.

FIG. 7 is an exploded view of the LSA plate 200 of FIG. 6. FIG. 8 is a cross-sectional view of the LSA plate of FIG. 6. Referring to FIGS. 7 and 8, LSA plate 200 includes synthetic jets 210. Each airfoil 250 may be paired with a synthetic jet 210. LSA plate 200 may include a cover 240 for each synthetic jet 210. Each cover 240 may be inserted into a cover cavity 204 extending into second base surface 209, the base of plate portion 205 opposite first base surface 206. Cover 240 may include a cylindrical shape with tabs 241 extending there from. Tabs 241 may interlock with plate portion 205 to secure cover 240 to plate portion 205. Cover cavity 204 may also include a cylindrical shape with a matching or slightly larger diameter than that of cover 240.

Each synthetic jet 210 includes a backside cavity 231 and a jet cavity 232. Backside cavity 231 may be sized to allow for deformation of disk 220. Backside cavity 231 may be a spherical cap shape. Other shapes, such as a conical shape with a rounded apex or a cylinder may also be used. In the embodiment illustrated, backside cavity 231 is located in cover 240.

Jet cavity 232 includes a frontside cavity 233, a cavity passage 234, and a jet passage 235. Frontside cavity 233 may adjoin cover cavity 204 and may be located between cover cavity 204 and airfoil 250 within plate portion 205. Frontside cavity 233 may be a cylindrical shape. Frontside cavity 233 and cover cavity 204 may align axially. Frontside cavity 233 adjoins backside cavity 231 when cover 240 is installed within cover cavity 204. The diameter of the cylindrical shape of frontside cavity 233 may be the same or similar to the diameter of the base of the spherical cap shape of backside cavity 231. The interface between plate portion 205 and cover 240 may be configured to secure disk 220 within cavity 230. Backside cavity 231 may be separated from frontside cavity 233 by disk 220. When disk 220 is in place, frontside cavity 233 may not be in flow communication with backside cavity 231.

Cavity passage 234 may be configured to direct the gas fluid between frontside cavity 233 and jet passage 235. Cavity passage 34 may extend from frontside cavity 233 within plate portion 205 and up into airfoil 250. In the embodiment illustrated, cavity passage 234 extends towards leading edge 256. In other embodiments, cavity passage 234 extends towards trailing edge 257.

Jet passage 235 extends between cavity passage 234 and a fluid stream interfacing surface 255. In the embodiment illustrated, fluid stream interfacing surface 255 is on the suction side 259. In other embodiments, the fluid stream interfacing surface 255 is on the pressure side 258. In the embodiment illustrated, jet passage 235 is located adjacent the leading edge 256. In other embodiments, jet passage 235 is located adjacent the trailing edge 257.

Jet passage 235 may be a slot or a cylinder. In the embodiment illustrated, jet passage 235 is a slot with a rectangular shape. In other embodiments, jet passage 235 is a slot with a stadium shape, a rectangle with circular capped ends. As illustrated, jet passage 235 is configured to prevent/reduce flow separation. In one embodiment, jet passage 235 is angled from 0 degrees to 7 degrees relative to the tangential direction of fluid stream interfacing surface 255 at the exit of jet passage 235. In another embodiment, jet passage 235 is angled from 0 degrees to 5 degrees relative to the tangential direction of fluid stream interfacing surface 255 at the exit of jet passage 235. In other embodiments, jet passage 235 is adjacent trailing edge 257 and is configured to modify the direction of a fluid traveling along fluid stream interfacing surface 255 and may be angled perpendicular to the surface.

The Helmholtz frequency of jet cavity 232 may be the same or similar to the Helmholtz frequency of jet cavities 32 and 132. The Various components of, size, and properties of disk 220 may be the same or similar to the components and size of disks 20 and 120, including the resonant frequency.

Figure 9:
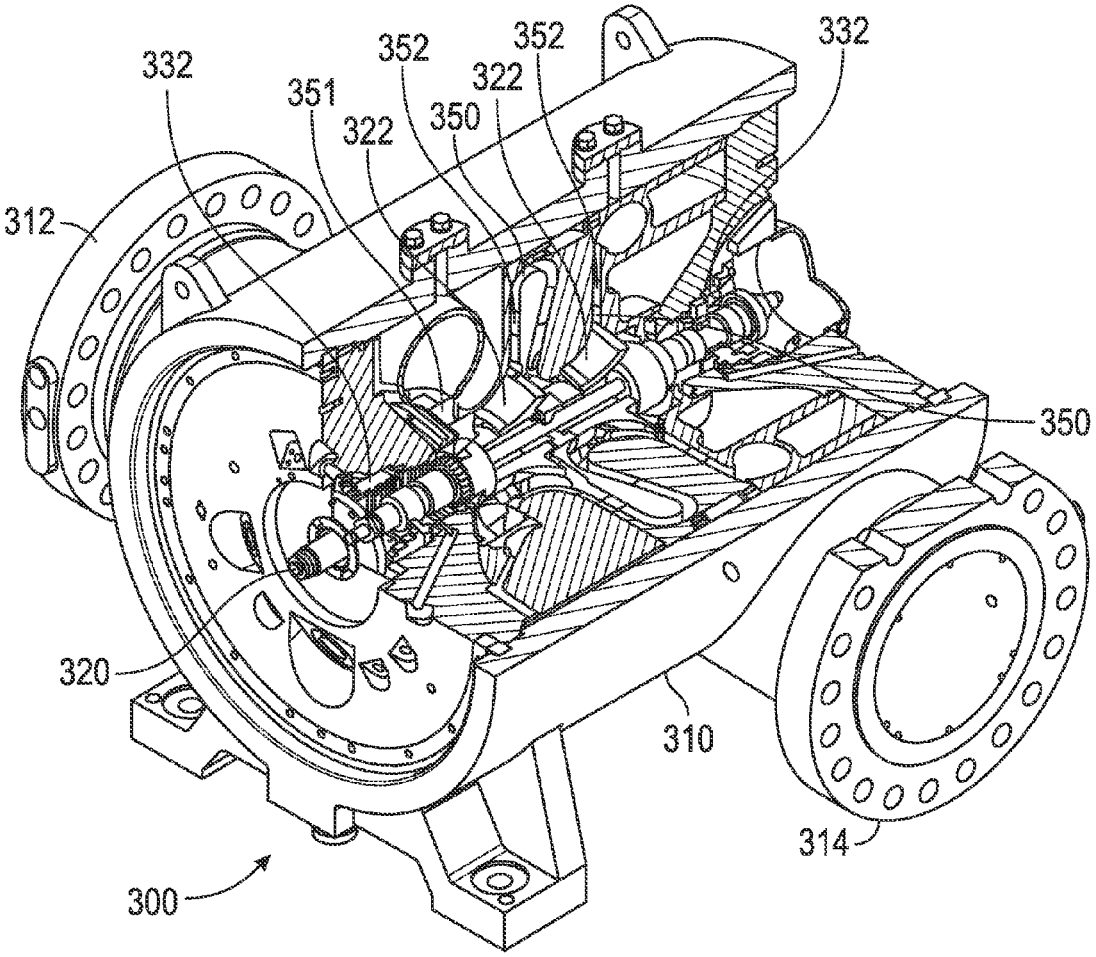
FIG. 9 is a centrifugal gas compressor.

FIG. 9 is a cutaway illustration of an exemplary centrifugal gas compressor 300. Process gas enters the centrifugal gas compressor 300 at a suction port 312 formed on a housing 310. The process gas is directed towards one or more centrifugal impellers 322 by inlet guide vanes 351. A set, such as an assembly of inlet guide vanes 351 may be adjacent and upstream the first impeller 322. The process gas is then compressed by accelerating the process gas with centrifugal impellers 322 mounted to a shaft 320 and converting the kinetic energy of the process gas to pressure in a diffuser 350 located downstream of each centrifugal impeller 322. Diffuser vanes 352 direct the process gas into the diffuser 350. A set, such as an assembly of diffuser vanes 352 may be adjacent each centrifugal impeller 322. The compressed process gas exits the centrifugal gas compressor 300 at a discharge port 314 that is formed on the housing 310. The shaft 320 and attached elements such as the centrifugal impellers 322 are supported by bearings 332 installed on axial ends of the shaft 320. The inlet guide vanes 351 and the diffuser vanes 352 may include either the airfoil assembly 150 of FIGS. 4-5 or the LSA plate 200 of FIGS. 6-8.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys.

One or more of the above components (or their subcomponents) may be made from . . . .

INDUSTRIAL APPLICABILITY

The operating range of a turbo-machine may depend on the angles of the stationary vanes disposed within the turbo-machine. As the flow of gas is increased/decreased through the turbo-machine, stationary vanes, such as inlet guide vanes may need to turn the flow of gas at a different angle. This is often accomplished using mechanical means, such as actuators, to physically turn the airfoils of the inlet guide vanes in the necessary direction. The mechanical means for turning the airfoils may wear over time, may be costly to repair, and may use a lot of space within the turbo-machine.

A stationary vane with synthetic jets 10 adjacent the trailing edge of the pressure side, such as airfoil assembly 150 of FIGS. 4-5, may be used to turn the flow of gas. To turn the primary flow of gas traveling through the stationary vane, the synthetic jets 10 are configured to inject a secondary flow of gas perpendicular to the primary flow. The oscillation of the disk 20 in each synthetic jet results in the creation of a pressure pocket of recirculating secondary flow. The recirculating secondary flow may change the streamline direction of the primary flow as the flow leaves the trailing edge of the airfoil, acting in a similar manner to that of a gurney flap. The use of synthetic jets 10 at the trailing edge may expand the operating range of the turbo-machine without the need for mechanically turning the airfoils.

The operating range of a turbo-machine may also be limited by flow separation on the surfaces of a diffuser, including flow separation on either the suction side or pressure side of a diffuser vane airfoil, such as airfoil 250 of LSA plate 200. Synthetic jets, such as synthetic jet 210 may be used to reduce or prevent flow separation from occurring. The synthetic jets may inject a secondary flow in a tangential direction relative to the surface of the airfoil, upstream of where the flow separation would occur. The tangential secondary flow may increase the momentum of the primary flow in a separated low momentum region along the surface, which may reduce the flow separation or prevent the flow separation from occurring, and may allow the operating range of the turbo-machine to be increased.

The preceding detailed description is merely exemplary in nature and is not intended to limit the invention or the application and uses of the invention. The described embodiments are not limited to use in conjunction with a particular type of fluid stream interfacing system for a turbo-machine. Hence, although the present disclosure, for convenience of explanation, depicts and describes an airfoil and an LSA plate with synthetic jets, it will be appreciated that the synthetic jets in accordance with this disclosure can be implemented in various other configurations, can be used with various other types of fluid stem interfacing systems for a turbo-machine, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A stationary vane for a turbo-machine, the stationary vane comprising:

an airfoil including
- a leading edge,
- a trailing edge, and
- a fluid stream interfacing surface extending between the leading edge and the trailing edge;

a synthetic jet including
- a backside cavity,
- a jet cavity including
  - a frontside cavity adjoining the backside cavity, and
  - a jet passage extending from the fluid stream interfacing surface towards the frontside cavity, the jet passage being in flow communication with the frontside cavity; and
- a disk located between the backside cavity and the frontside cavity, the disk including a cylindrical disk with a cylindrical shape, and a coating on each side of the cylindrical disk, the coating being a piezo electric ceramic material; and wherein the airfoil includes a first body portion including the leading edge, the trailing edge, and the jet cavity; and a second body portion including a portion of the fluid stream interfacing surface and the backside cavity, the second body portion being affixed to the first body portion securing the disk between the backside cavity and the frontside cavity.

2. The stationary vane of claim 1, wherein the jet cavity is configured to have a Helmholtz frequency within 200 Hertz of a resonant frequency of the disk.

3. The stationary vane of claim 2, wherein the resonant frequency of the disk is from 1150 Hertz to 1250 Hertz.

4. The stationary vane of claim 1, wherein the fluid stream interfacing surface is on a pressure side of the airfoil.

5. The stationary vane of claim 4, wherein the jet passage is located adjacent the trailing edge and is configured to inject a fluid perpendicular to the fluid stream interfacing surface.

6. The stationary vane of claim 1, wherein the jet cavity includes a static volume from 4.11 $cm^3$ to 4.47 $cm^3$.

7. A synthetic jet for a turbo-machine including a fluid stream interfacing structure with a fluid stream interfacing surface, the synthetic jet comprising:

a disk including a cylindrical disk including a cylindrical shape and a diameter from 40.8 millimeters to 41.2 millimeters, and a coating located on each side of the cylindrical disk, the coating being a piezo electric ceramic material;

a backside cavity located in the fluid stream interfacing structure; and a jet cavity configured to have a Helmholtz frequency within twenty percent of a resonant frequency of the disk located in the fluid stream interfacing structure, the jet cavity including a frontside cavity adjoining the backside cavity, the frontside cavity being separated from the backside cavity by the disk, a cavity passage extending from the frontside cavity towards the fluid stream interfacing surface, and a jet passage extending from the fluid stream interfacing surface to the cavity passage, the jet passage being in flow communication with the frontside cavity; and wherein the backside cavity includes a conical shape with a rounded apex and a second diameter at a base of the conical shape, and the frontside cavity includes a second cylindrical shape with a third diameter.

8. The synthetic jet of claim 7, wherein the resonant frequency of the disk is from 1150 Hertz to 1250 Hertz.

9. The synthetic jet of claim 8, wherein the Helmholtz frequency of the jet cavity is within 200 Hertz of the resonant frequency.

10. The synthetic jet of claim 7, wherein the coating on each side of the cylindrical disk includes a second diameter from 28.0 millimeters to 28.4 millimeters and a thickness from 0.1778 millimeters to 0.2032 millimeters.

11. The synthetic jet of claim 7, wherein the cylindrical disk includes brass.

12. The synthetic jet of claim 7, wherein the jet passage is angled perpendicular to a portion of the fluid stream interfacing surface adjacent the jet passage.

13. A compressor, comprising:

a shaft;

an impeller mounted to the shaft; and a stationary vane assembly including a plate portion with an annular shape, the plate portion including a first base surface, a second base surface opposite the first base surface, an outer edge, an inner edge located inward from the outer edge, and a plurality of cover cavities extending from the second base surface towards the first base surface, a plurality of covers, each cover of the plurality of covers located in one of the plurality of cover cavities, a plurality of airfoils extending from the first base surface in the direction opposite the second base surface, each airfoil of the plurality of airfoils including a leading edge adjacent the inner edge, a trailing edge adjacent the outer edge, and a fluid stream interfacing surface extending between the leading edge and the trailing edge, and a plurality of synthetic jets, each synthetic jet of the plurality of synthetic jets including a backside cavity located within one of the plurality of covers, a jet cavity including a frontside cavity in the plate portion adjoining the backside cavity, a cavity passage extending from the frontside cavity into one of the plurality of airfoils, and a jet passage extending from the cavity passage to the fluid stream interfacing surface, and a disk between the backside cavity and the frontside cavity, the disk including a cylindrical disk with a cylindrical shape, and a coating on each side of the cylindrical disk, the coating being a piezo electric ceramic material.

14. The compressor of claim 13, wherein the jet passage is a slot.

15. The compressor of claim 13, wherein the jet passage is configured to inject a fluid from 0 degrees to 7 degrees relative to a tangential direction of the fluid stream interfacing surface towards the trailing edge.

16. The compressor of claim 13, wherein the fluid stream interfacing surface is in a suction side of the airfoil.

17. The compressor of claim 13, wherein the disk includes a resonant frequency from 1150 to 1250 Hertz and the jet cavity is configured to have a Helmholtz frequency within 200 Hertz of the resonant frequency of the disk.

18. The compressor of claim 13, wherein the jet cavity includes a static volume from 4.592 $cm^3$ to 4.920 $cm^3$.

* * * * *